United States Patent [19]

Doelling

[11] 4,056,886

[45] Nov. 8, 1977

[54] DRESSMAKER'S AID WITH ROTATING PLATFORM

[76] Inventor: Sylvia Lee Doelling, 309 N.E. 1st St., Delray Beach, Fla. 33444

[21] Appl. No.: 670,092

[22] Filed: Mar. 24, 1976

[51] Int. Cl.[2] ..... A41H 21/00

[52] U.S. Cl. ..... 33/10

[58] Field of Search ..... 33/10, 2 H; 108/20, 108/147

[56] References Cited

U.S. PATENT DOCUMENTS

| | | | |
|---|---|---|---|
| 832,049 | 10/1906 | Feld | 33/10 |
| 923,029 | 5/1909 | D'Elia | 33/10 |
| 944,570 | 12/1909 | Moritz | 33/10 |
| 2.502,287 | 3/1950 | Stewart | 33/10 |
| 2,565,335 | 8/1951 | White | 33/10 |
| 3,343,901 | 9/1967 | Marcus | 33/10 X |

FOREIGN PATENT DOCUMENTS

| | | | |
|---|---|---|---|
| 192,097 | 10/1906 | Germany | 108/147 |

*Primary Examiner*—Charles E. Phillips
*Attorney, Agent, or Firm*—Ernest H. Schmidt

[57] ABSTRACT

A base structure supports a relatively rotatable and vertically adjustable platform upon which the wearer of a garment to be fitted stands, the base structure further supporting a relatively fixed stool for the dressmaker's use in effecting hemline marking, pinning and the like of the garment being fitted and including storage compartments within handy reach of the dressmaker seated on the stool.

2 Claims, 6 Drawing Figures

DRESSMAKER'S AID WITH ROTATING PLATFORM

This invention relates to the art of dressmaking and is directed particularly to a device which aids a dressmaker in performing hemming, pinning and the like operations in the making of women's garments.

The principal object of this invention is to provide an improved device enabling a skirt or other garment to be marked while being worn and while the wearer is rotated relative to the dressmaker.

A prior art device which is designed to perform a function similar to that of the invention is disclosed in U.S. Pat. No. 2,565,335 (White). The White patent discloses a hem marker for skirts which includes a base for rotatably mounting a platform on which the person wearing the garment to be marked stands, a guard railing construction which extends upwardly from the platform and provides an arm rest for the garment wearer, and a vertically and horizontally adjustable tape dispensing device mounted on the railing construction and moveable with respect thereto. The tape is dispensed against the surface of the garment as the platform, and thus the wearer, are slowly rotated so as to provide the desired marking. The platform itself is supported on rollers and driven by an electric motor through speed reduction gearing and a worm and worm gear arrangement.

Reference is also made to U.S. Pat. No. 2,691,220 (Groves) which discloses a skirt marker including a turntable driven by a motor and gear arrangement.

In accordance with the present invention, a dressmaker's aid or aid device is provided which affords a number of advantages not found in hem markers heretofore devised.

The device of the present invention is considerably more flexible than a conventional hem marker and aids the dressmaker in performing hemming, pinning and like operations. To this end, a stool is provided which is mounted on a support plate which extends outwardly of the platform section and thus is an integral part of the device. The relative position of the stool is such that the dressmaker is placed in optimum relationship to the garment wearer as well as to the controls for the device. A reversible motor provides flexibility in operation and a storage drawer, located in ready reach of the dressmaker within a base compartment upon which the rotating platform is mounted, adds to the overall convenience and utility.

A salient feature of the invention resides in the provision of means for raising and lowering the platform at the will of the operator.

Other objects, features and advantages of the invention will be apparent from the following description when read with reference to the accompanying drawings. In the drawings, wherein like reference numerals denote corresponding parts throughout the several views.

Figure 1:
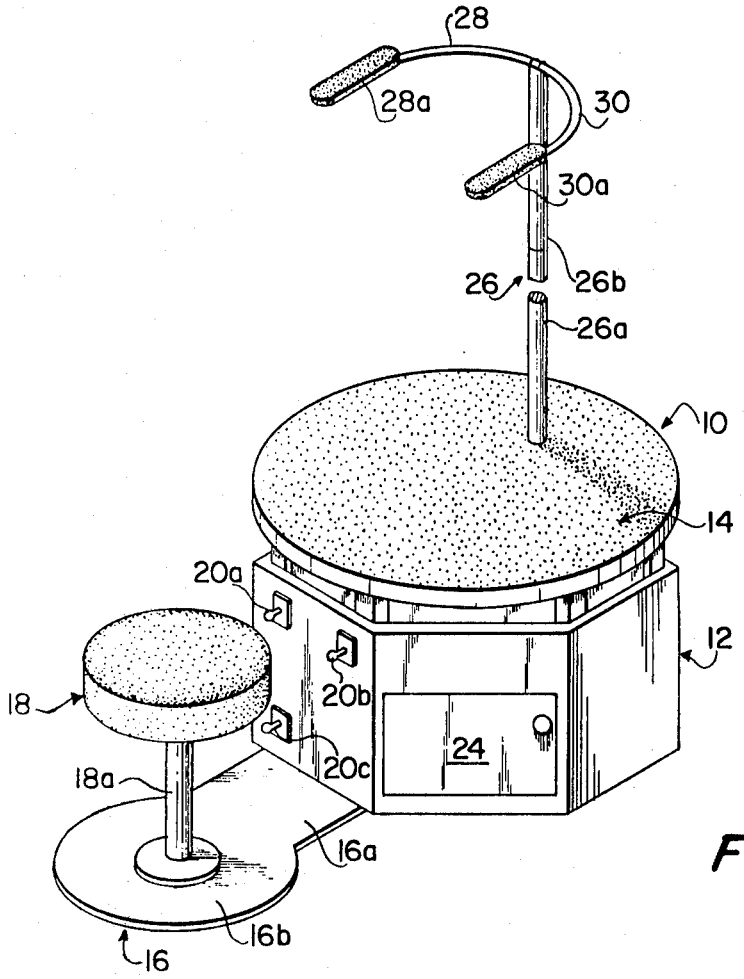
FIG. 1 is a perspective view of a dressmaker's aid embodying the invention.

Referring to FIG. 1, a perspective view of the dressmaker's aid of the invention is shown. The aid or aid device, which is generally denoted by reference numeral 10, includes a base compartment 12 and a rotatable platform 14 supported thereon. A horizontal support plate 16 is affixed to and extends outwardly of base compartment 12. Support plate 16 includes a straight portion **16*a* and a generally circular portion 16*b* and serves to mount a stool 18. Stool 18 includes an upright support post 18*a* and is positioned relative to base compartment 12 so as to provide ready access to control switches 20*a*, 20*b* and 20*c* and a pair of drawers 22 and 24 (see FIG. 3**), described in more detail hereinbelow.

Platform 14 is generally circular in shape and an upright support post 26 is mounted thereon near the periphery thereof, as illustrated. Support post 26 includes first and second frictionally adjustable telescoping sections **26*a* and 26*b*, and terminates in a pair of curved arm rests 28 and 30. Arm rests 28 and 30 include pads 28*a* and 30*a***, respectively, which fit on the ends thereof.

Figure 3:
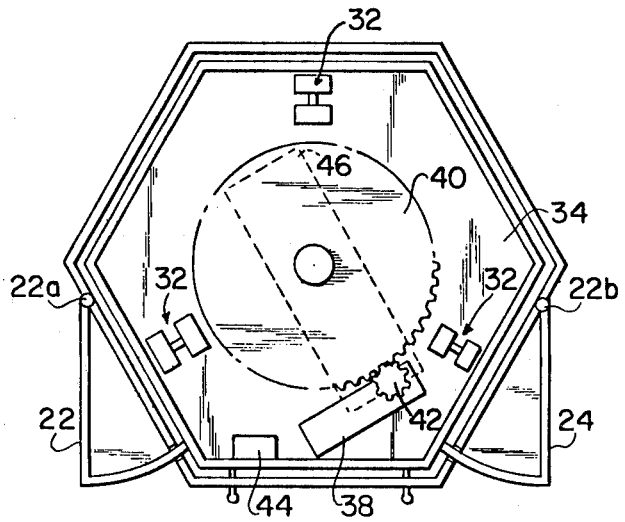
FIG. 3 is a plan cross-sectional view taken generally along line III—III of FIG. 2.
Figure 2:
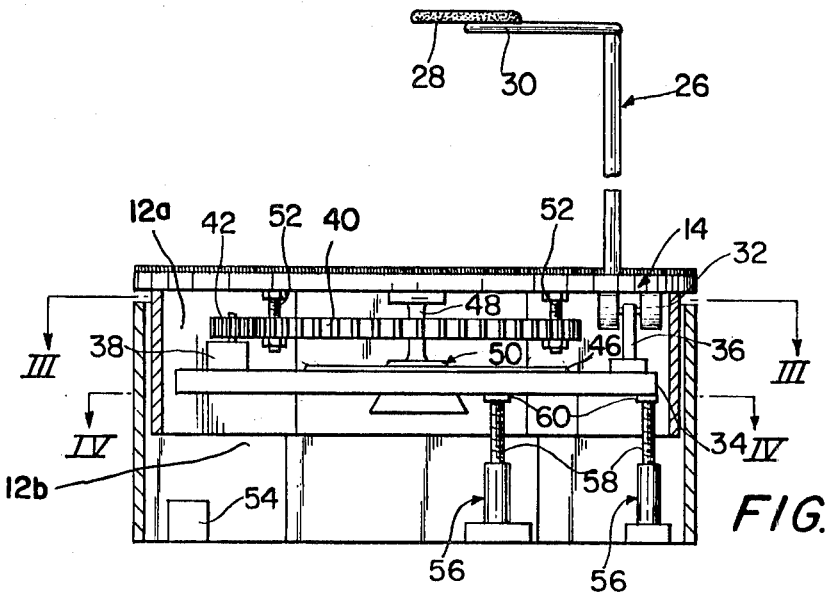
FIG. 2 is a transverse cross-sectional view of the dressmaker's aid of FIG. 1, illustrating the rotary drive and the raising and lowering mechanism thereof.
Figure 4:
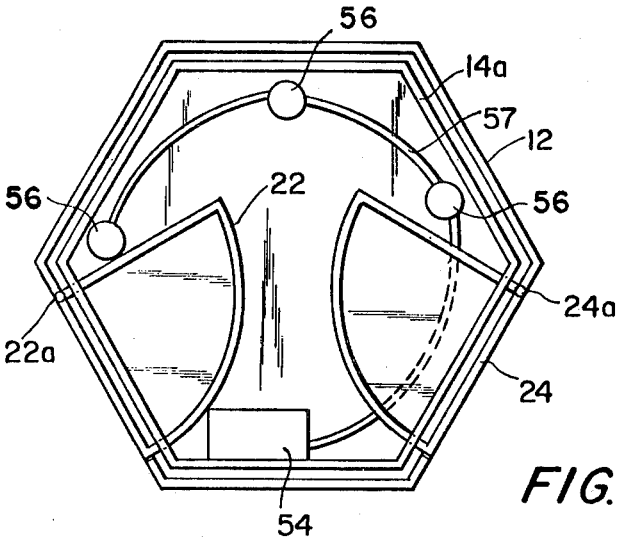
FIG. 4 is a plan cross-sectional view taken generally along line IV—IV of FIG. 2.

Referring to FIGS. 2 to 4, platform 14 rests upon a series of radially spaced rollers 32 which are positioned about the periphery of a ring gear 40 described below (see FIG. 3) and which are mounted on an intermediate support member or floor 34 by adjustable mountings 36 (see FIG. 2). The latter permit the height of the rollers 32 to be varied relative to floor 34.

Support floor 34 also mounts a reversible electric motor 38 which drives ring gear 40 through an intermediate drive gear or pinion 42. Motor 38 is adapted to energized from a standard household outlet through a transformer 44 and a suitable wall plug (not shown). The transformer 44 also includes a rectifier (not shown) for converting the A.C. household voltage into a D.C. voltage, transformer 44 serving to step down this voltage to a low, safe level. Switches **20*a* and 20*b*, referred to above serve to control the energization and the direction of rotation of motor 38**, respectively.

The motor 38 is mounted on a rectangular base plate 46 (see FIG. 3), secured to floor 34. Ring gear 40 has a relatively fixed axial stub shaft 48 the upper end of which is secured to the underside of the platform 14 and the lower end of which is journalled in a thrust bearing 50 fixed with respect to floor 34. Ring gear 40 is affixed to platform 14 by a plurality of bolts 52 which extend therebetween as shown in FIG. 2. Thus, energization of motor 38 will cause rotation of ring gear 40 and hence of platform 14, upon rollers 32.

Figure 6:
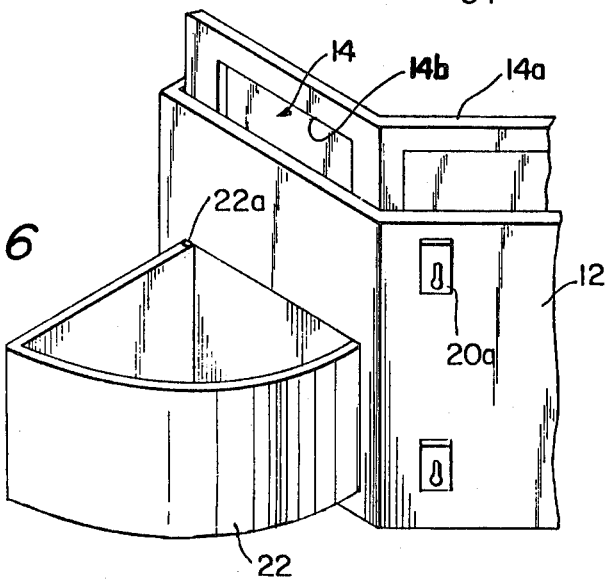
FIG. 6 is a perspective view of a detail of the dressmaker's aid of FIG. 1.

Platform 14 includes a downwardly depending skirt portion **14*a* (see FIG. 6) which is of the same hexagonal shape as base compartment 12 and telescopes therewithin with the respective side walls being parallel as can best be seen in FIGS. 3 and 4. The upper surface of the platform 14 extends laterally over the top of the section 12*a***.

Figure 5:
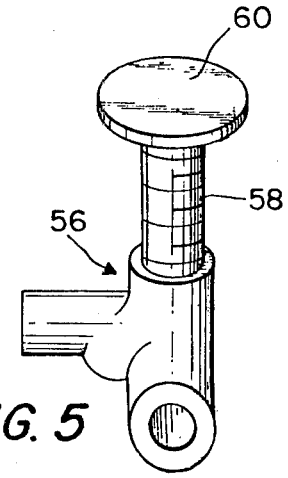
FIG. 5 is a perspective view of one of the screw jacks shown in FIGS. 2 and 4.

The mechanism for raising and lowering platform 14 is best seen in FIGS. 2 and 4. This mechanism includes a reversible drive motor 54 which drives a series of three screw jacks 56. This arrangement is of conventional construction and the screw jacks 36 are mechanically driven through a flexible connecting cable 57 and, as is shown in FIG. 5, each includes a screw threaded rod 58 having a headed end 60 which contacts the undersurface of support floor 34. As can best be seen in FIG. 2, support floor 34 divides the interior of base compartment 12 into an upper portion or chamber 12*a* and a lower portion or chamber 12*b*. The rollers 32 and the drive mechanism including motor 38 are located within the upper chamber 12*a* while the raising and lowering mechanism including motor 54 and jacks 56 is located within lower section 12*b*. Energization of motor 54 is controlled by control switch 20*c* mentioned above.

Drawers 22 and 24 are in the shape of a sector of a circle when viewed in plan, as shown in FIG. 4. Drawers 22 and 24 are hinged at pins 22*a* and 24*a*, respectively, so that they swing out about their respective hinges, as shown in FIG. 3. The skirt portions 14*a* of platform 14 is cut out as indicated at 14*b* in FIG. 6 to accommodate the drawers 22 and 24, that is, so that the drawers can extend therethrough.

The operation of the dressmaker's aid of the invention will be evident from the foregoing. The operator sits on stool 18 while the wearer of the garment to be hemmed or otherwise worked on stands on platform 14 with her arms resting on arm rest pads 28*a* and 38*a*, the height of support post 26 being adjusted accordingly. The operator energizes the motor 38 by means of switch 20*a* and the direction of rotation of platform 14 is controlled by switch 20*b*. The operator can raise or lower the platform through use of switch 20*c*. Switch 20*c* is a three position switch having "up", "down", and "off" positions. It will be appreciated that the operator, when seated on stool 18, has ready access to the control switches 20*a*, 20*b*, and 20*c* as well as to storage drawers 22 and 24.

Although the invention has been described relative to an exemplary embodiment thereof, it will be understood by those skilled in the art that variations and modifications can be effected in this embodiment without departing from the scope and spirit of the invention.

What I claim as new and desire to secure by Letters Patent is:

1. A dressmaker's aid comprising, in combination, an emclosed base compartment, and a circular platform having a downwardly-depending skirt portion, said base compartment and said skirt portion respectively comprising first and second relatively telescoping sections, each of said telescoping sections including a plurality of upwardly-extending sidewalls, the outer faces of the sidewalls of said second relatively telescoping section being in face to face relatively parallel disposition with the inner faces of one each of said upwardly-extending sidewalls of said first relatively telescoping sections, a stool for the dressmaker fixed with respect to and spaced laterally outwardly of said first relatively telescoping section a said circular platform rotatably mounted with respect to and above said second telescoping section means for supporting and rotating said platform with respect to said said telescoping section means for raising and lowering said second telescoping section and its associated platform with respect to said first telescoping section, said platform rotating means comprising a reversible electric motor, electric switch means supported on said first telescoping section and within reach of the dressmaker seated on said stool for controlling both the operation and direction of turning of said rotatably mounted platform, said platform raising and lowering means comprising a reversible electric motor and electric switch means supported on said first telescoping section and within reach of the dressmaker seated on said stool for selectively controlling the raising and lowering of said platform with respect to said first telescoping section, the upper surface of said circular platform being of a larger diameter than said second telescoping section such as to extend laterally over the top of said second telescoping section.

2. A dressmaker's aid as defined in claim 1, and further including a support post extending upwardly from said platform and having at its upper end first and second curved arm rests extending laterally outwardly therefrom.

* * * * *